US005833077A

United States Patent [19]

Engel

[11] Patent Number: 5,833,077

[45] Date of Patent: Nov. 10, 1998

[54] DISPLAY HOOK SYSTEM

[75] Inventor: Harvey Engel, Boca Raton, Fla.

[73] Assignee: P. O. P. Displays, Inc., Woodside, N.Y.

[21] Appl. No.: 761,095

[22] Filed: Dec. 5, 1996

[51] Int. Cl.[6] ..... G09F 3/00

[52] U.S. Cl. ..... 211/59.1; 40/642.01; 211/57.1

[58] Field of Search ..... 211/59.1, 57.1, 211/87, 106; 40/642.01, 661.03, 657

[56] References Cited

U.S. PATENT DOCUMENTS

| | | | |
|---|---|---|---|
| 4,754,563 | 7/1988 | Fast | 40/642.01 X |
| 4,805,861 | 2/1989 | Thalenfeld et al. | 40/642.01 X |
| 5,235,766 | 8/1993 | Fast et al. | 40/642.01 X |
| 5,325,616 | 7/1994 | Valiulis | 40/642.01 |
| 5,421,113 | 6/1995 | Gebka et al. | 40/642.01 |
| 5,429,334 | 7/1995 | Hutchison | 40/657 X |
| 5,645,175 | 7/1997 | Wood | 211/57.1 |

*Primary Examiner*—Peter M. Cuomo
*Assistant Examiner*—Stephen Vu
*Attorney, Agent, or Firm*—Nolte, Nolte & Hunter

[57] ABSTRACT

A unitary molded frame includes an article support and a first display wall fixedly mounted on the frame above the article support. A second unitary molded element includes a second display wall and a third display wall. The second unitary molded element is mounted movably on the frame so that the second display wall can be moved to a first position at which said second display wall faces the first display wall and the third display wall is presented for viewing by an observer; and the second display wall can be moved to a second position at which the second display wall and the first display walls are presented for viewing by an observer.

6 Claims, 7 Drawing Sheets

DISPLAY HOOK SYSTEM

BACKGROUND OF THE INVENTION

1. Field of the Invention

The invention pertains to article support and information display, more specifically to a system that holds an article and displays information about the article on a fixed panel and on a movable dual-display panel. The dual display panel may be moved in front of and away from the front of the fixed panel display, and can be moved to present one or the other display of the dual displays.

2. Description of the Prior Art

The prior art is replete with patents for article supports which have accompanying displays.

For example, U.S. Pat. No. 4,540,093 patented Sep. 10, 1985 by Merl et al., describes a U-shaped wire having horizontally extending, vertically oriented legs. The base of the U is bridged by a smaller U-shaped hook which hooks into perforations of a peg-board. The lower leg of the horizontal U is for supporting an article by draping the article over the leg or hanging it from the leg. The upper leg of the U pivotally holds a panel along one side of the panel so that the panel can be rotated on the upper leg to alternately present the front side or the back side of the panel to a viewer.

U.S. Pat. No. 4,805,861 patented Feb. 21, 1989 by Thalenfeld et al., describes a U-shaped wire having horizontally extending, vertically oriented legs. The base of the U is bridged by a smaller U-shaped hook which hooks into perforations of a peg-board. The lower leg of the horizontal U is for supporting an article by draping the article over the leg or hanging it from the leg. The upper leg of the U fixedly holds a metal plate which is welded to the leg. A plastic panel has vertical channels on the back of the panel for mounting it on the plate, and horizontal channels on the front of the panel at the top and bottom of the panel for holding a label.

U.S. Pat. No. 5,080,238, patented Jan. 14, 1992 by Arthur Hochman, describes a bracket having rearward depending fingers for attaching the bracket to a pegboard, and a forward facing keyway. A pair of horizontally extending, vertically oriented rods are integrally molded with a T-shaped key from which they extend. The T-shaped key removably fits in the keyway of the bracket. A panel is fixedly attached at the back of the panel to the upper rod so that the panel is integral with the rods and T-shaped key. The front of the panel faces forward for viewing of information which may be placed thereon.

U.S. Pat. No. 5,348,167, patented Sep. 20, 1994 by Palle L. Jensen, describes a bracket having rearward depending fingers on the top of the bracket for inserting in holes in a pegboard for mounting the bracket on the peg board. The bracket holds the base of a metal U-shaped rod in a slot so that the legs of the U extend horizontally and are vertically oriented when the bracket is mounted on a vertical pegboard. The slot is internally interrupted so that the bracket can be rotated at the fingers by the user to remove the bracket from or attach it to the pegboard while the user keeps the legs horizontal. Information concerning the product hung on the lower leg is displayed by a plastic sign holder that rotatably hangs from a pivot that is attached to a socket keyed to slide on a flattened end of the upper leg. The plastic sign holder can be rotated up to clear the way for removal of product from the lower leg.

U.S. Pat. No. 5,442,872, patented Aug. 22, 1995 by Richard Moser, describes a bracket that attaches to an article support prong and has an arm which extends from the top of the bracket, horizontally, above and parallel with the prong. The forward end of the arm has a transverse cylindrical pivot pin. Upon the pivot pin, a transparent plastic pocket for holding an information display hangs by its upper edge from a downwardly open channel having a cylindrical inner surface. This enables the pocket to repeatedly swing upward as each article is removed from the prong.

SUMMARY OF THE INVENTION

It is one object of the invention to provide a display hook system that has a fixed-in-place, information display surface.

It is another object that the system includes a panel having a second information display surface and a third information display surface.

It is another object that the panel having the second and third information surfaces is movable so that the second information display surface can be moved to face the fixed information display surface and the third information display surface is presented for viewing.

It is another object that the panel can be moved so that the fixed information display surface and the second information display surface are simultaneously presented for viewing.

It is another object that the system provides article support means.

It is another object that the three information display surfaces are connected to the article support means and to means for attaching the display hook system to a wall.

It is another object that the display hook system consists of two molded elements.

Other objects and advantages will become apparent from reading the ensuing description of the invention.

A base and a first panel have support means attached to each for supporting the first panel spaced from the front of the base. A second panel is mounted on the support means so that a first side of the second panel can be moved from a first position in which the first side faces the front of the first panel and in which a second side of the second panel is presented for viewing by an observer; to a second position in which first side is away from facing the front of the first panel, in which the first side and the front of the first panel are presented for viewing by an observer. Article support means is mounted on the base and adapted for supporting an article below the support means.

In one embodiment the mounting of the predetermined second panel for the above movements is provided by pivot means mounted on the first panel.

In another embodiment a first unitary molded frame includes first means for supporting an article and a first display wall fixedly mounted on the frame above the first means for supporting an article. A second unitary molded element includes a second display wall and a third display wall. The second unitary molded element is mounted movably on the frame so that the second display wall can be moved to a first position at which the second display wall faces the first display wall and the third display wall is presented for viewing by an observer; and the second display wall can be moved to a second position at which the second display wall and the first display walls are presented for viewing by an observer.

A method for displaying information associated with article support means includes moving a first display wall so that it faces a third display wall and so that a second display wall attached to the first display wall is presented for viewing by an observer; and moving the first display wall away from facing the third display wall so that the first display wall and the third display wall are presented for viewing by an observer, the moving of the first display wall being above said article support means.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
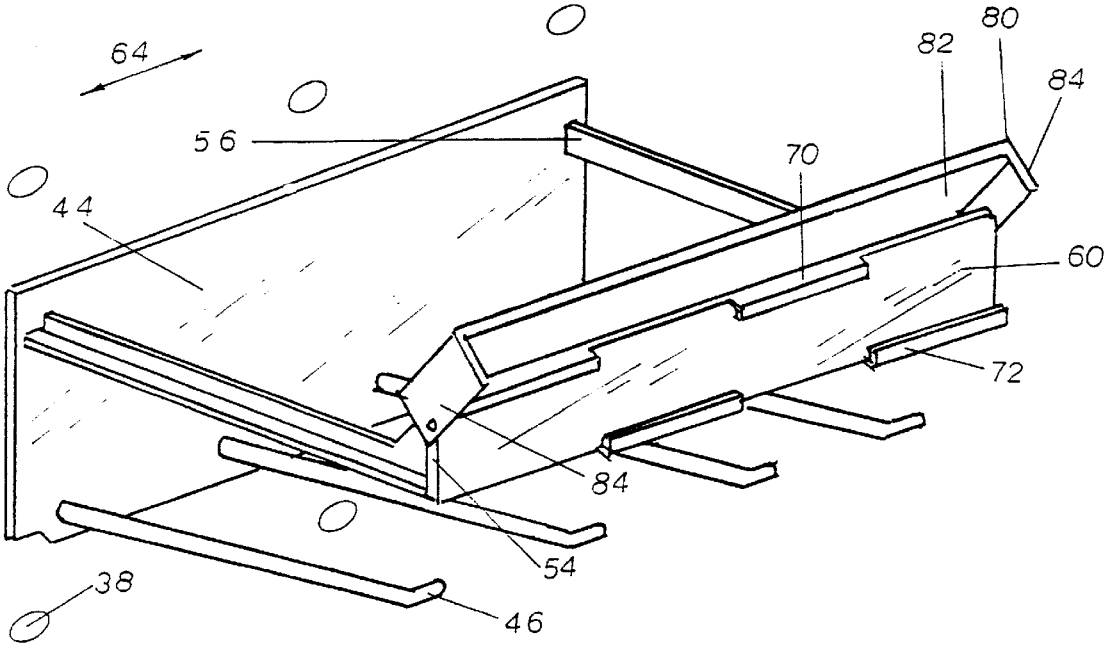
FIG. 1 is a perspective view of a display hook system of the present invention, mounted on a perforated wall.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIGS. 1, 2, 3, and 4, display hook system 30 is mounted on display wall 34 by way of a plurality of mounting fingers 36, each finger in one of perforations 38.

Panel 44 rests against wall 34 and provides support for hangar rod 46 which is used to support various articles for sale. Also panel 44 provides support for display panel 54 by way of arm 56 which extends from panel 44 forward of panel 44 generally normal to panel 44. Support arm 56 is rigidly attached to panels 44 and 54. As best seen in FIGS. 1–6, support arm 56 is formed with a strengthening rib 56' along its length with upstanding leg 56" at its outer front end.

Although a rod 46 is shown, other article support means may be used such as a hook or clamp. The article support means is adapted for supporting an article or articles below arm 56 and preferably is attached to the bottom of panel 44 and extends forward of panel 44.

For convenience in understanding the construction of the embodiment, also refer to FIGS. 5–14 in which additional details of construction are shown.

Front 60 of display panel 54 has a generally flat surface which is large enough to display information such as a UPC bar code which is related to the item that will be on hangar rod 46. Preferably, panel 54 is parallel to panel 44. Preferably display hook system 30 has a plurality of juxtaposed hooks along the length 64 of display panel 54.

Upper and lower slots 70 and 72 respectively provide means for holding one or more information display cards for reading by eye or machine.

Figure 4:
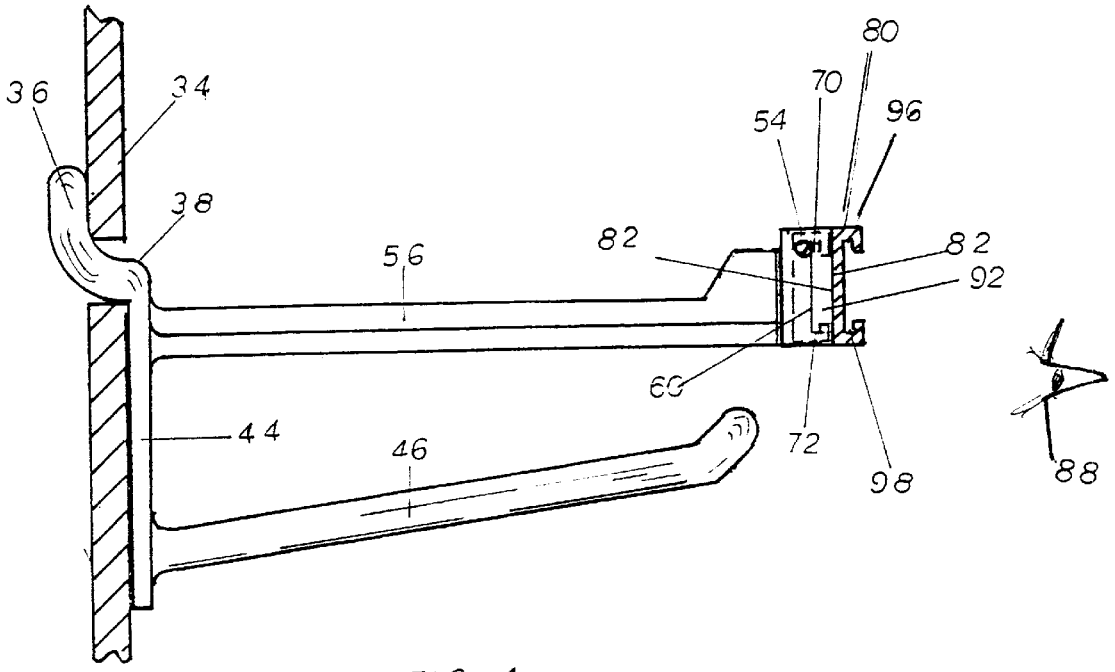
FIG. 4 is a left side view of the system of FIG. 1, with a rotatable panel of the system. The panel is shown in cross section along lines 2—2 of FIG. 9.
Figure 5:
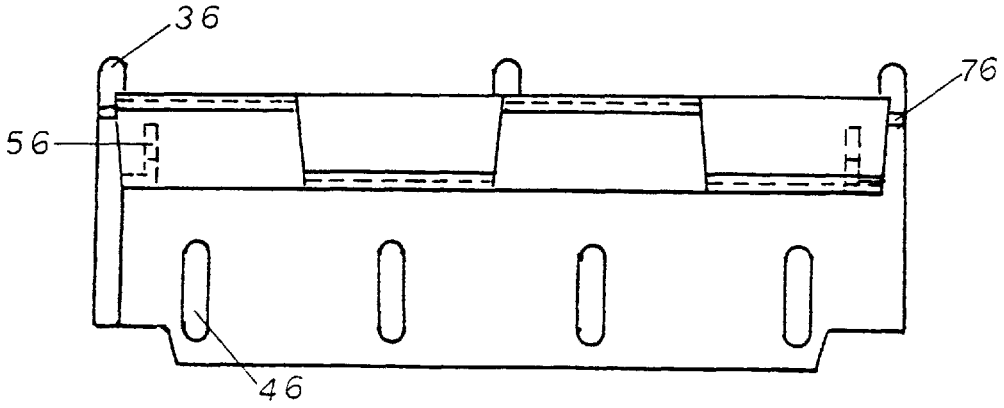
FIG. 5 is a front view of the system of FIG. 1 without the rotatable panel.
Figure 6:
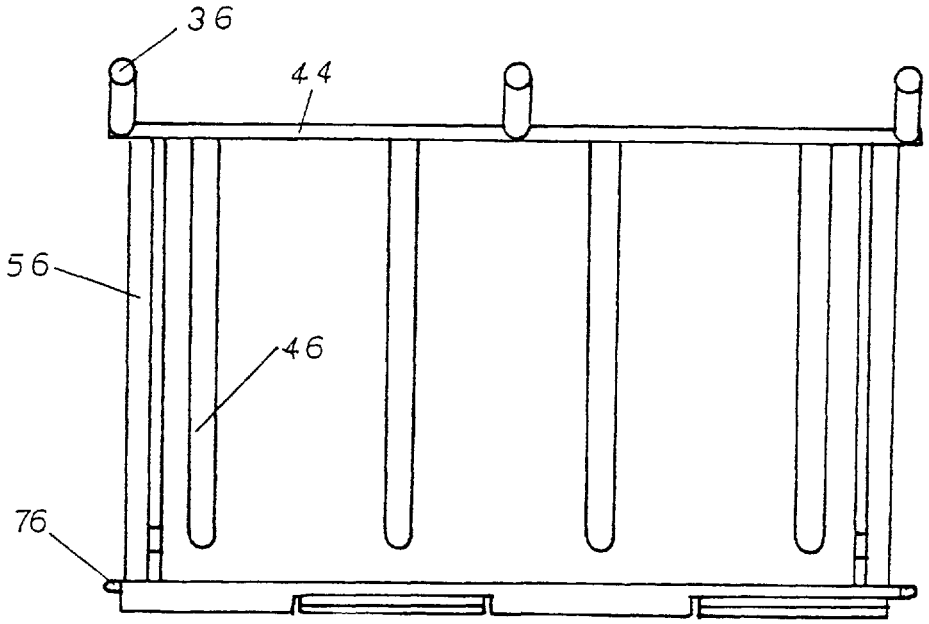
FIG. 6 is a top view of the system of FIG. 5.
Figure 7:
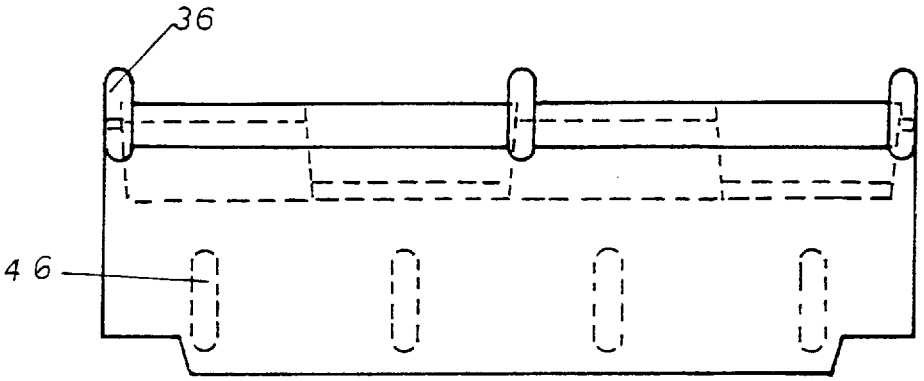
FIG. 7 is a back view of the system of FIG. 5.
Figure 8:
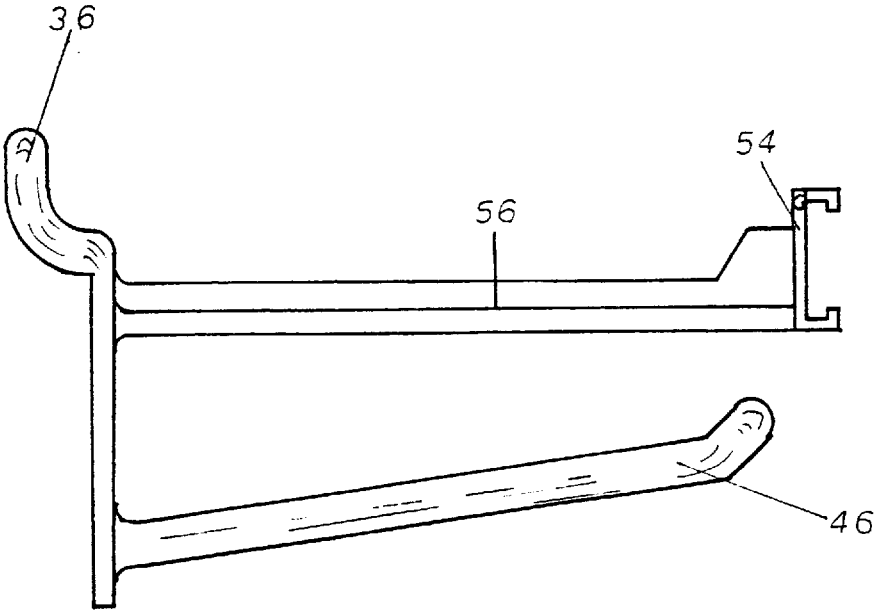
FIG. 8 is a left side view of the system of FIG. 5.
Figure 9:
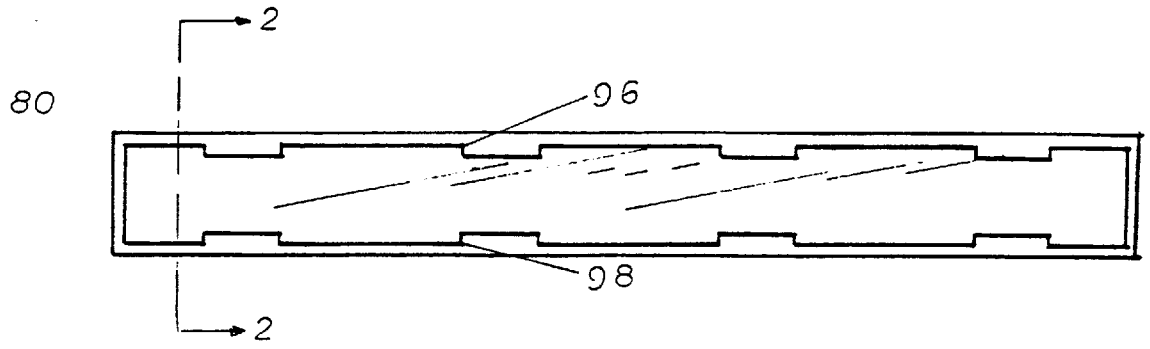
FIG. 9 is a front view of the rotatable panel of FIG. 1.
Figure 10:
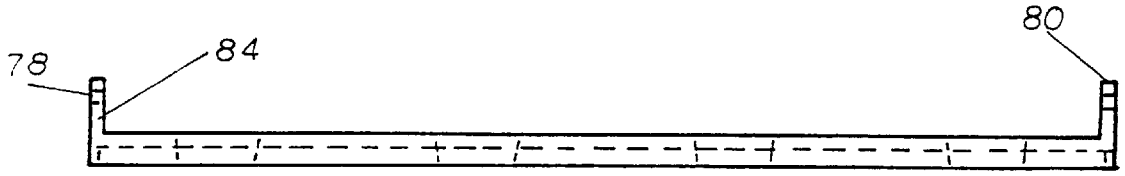
FIG. 10 is a top view of the rotatable panel of FIG. 9.
Figure 11:
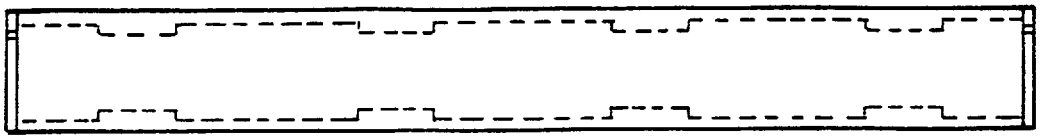
FIG. 11 is a back view of the rotatable panel of FIG. 9.
Figure 12:
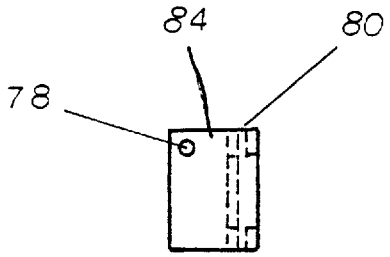
FIG. 12 is a side view of the rotatable panel of FIG. 9.
Figure 13:
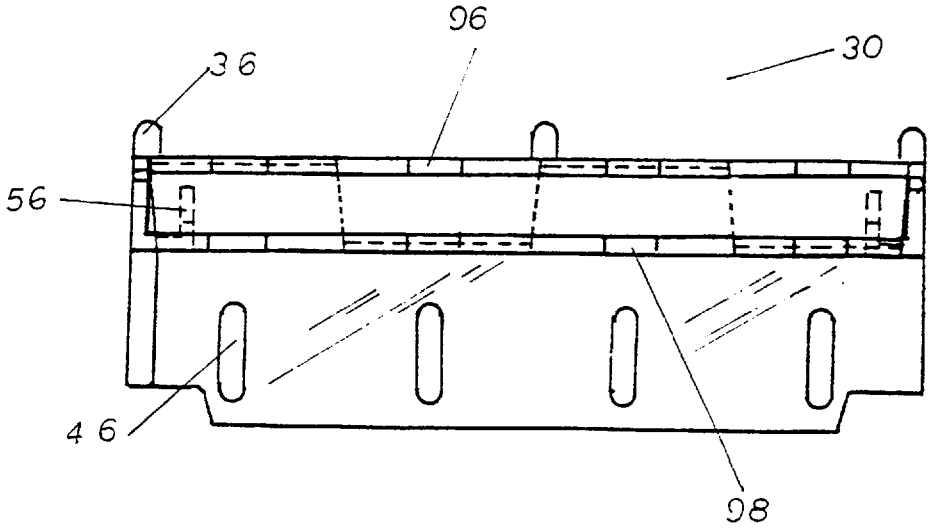
FIG. 13 is a front view of the system of FIG. 4.
Figure 14:
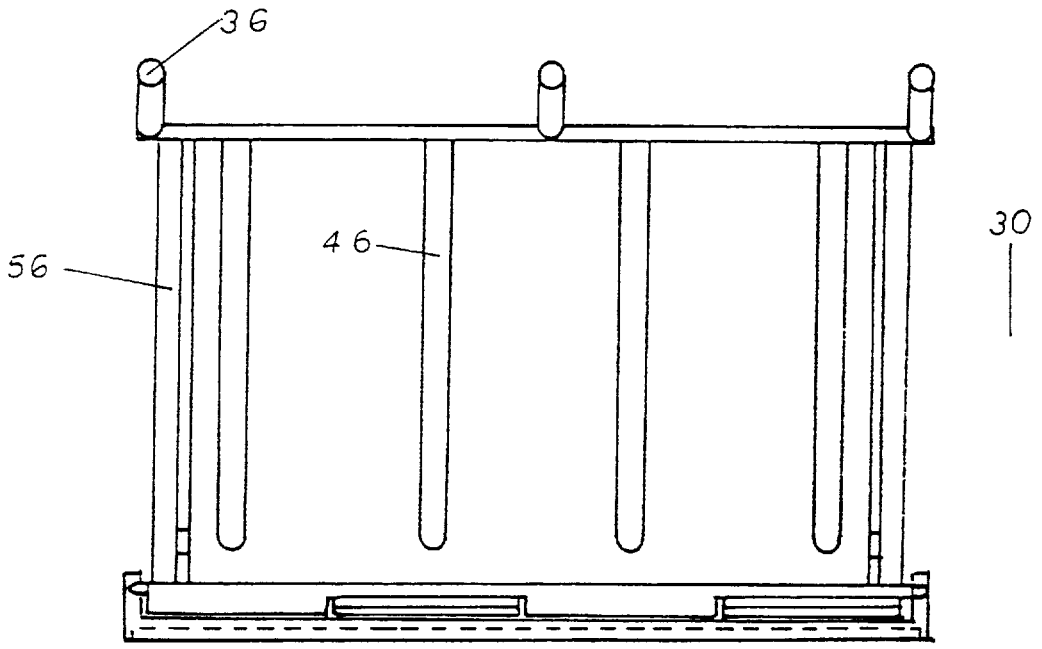
FIG. 14 is a top view of the system of FIG. 4.

Pivot pins 76 are intergrally formed, one on the upper portion of each end of display panel 54 as best seen in FIGS. 5 and 6, and support dual display panel 80 for rotation on display panel 54. As best seen in FIGS. 1–6 and 12, side walls 84, 84' of panel 80 provide bearing recesses 80 in which the pivot pins rotate.

Figure 2:
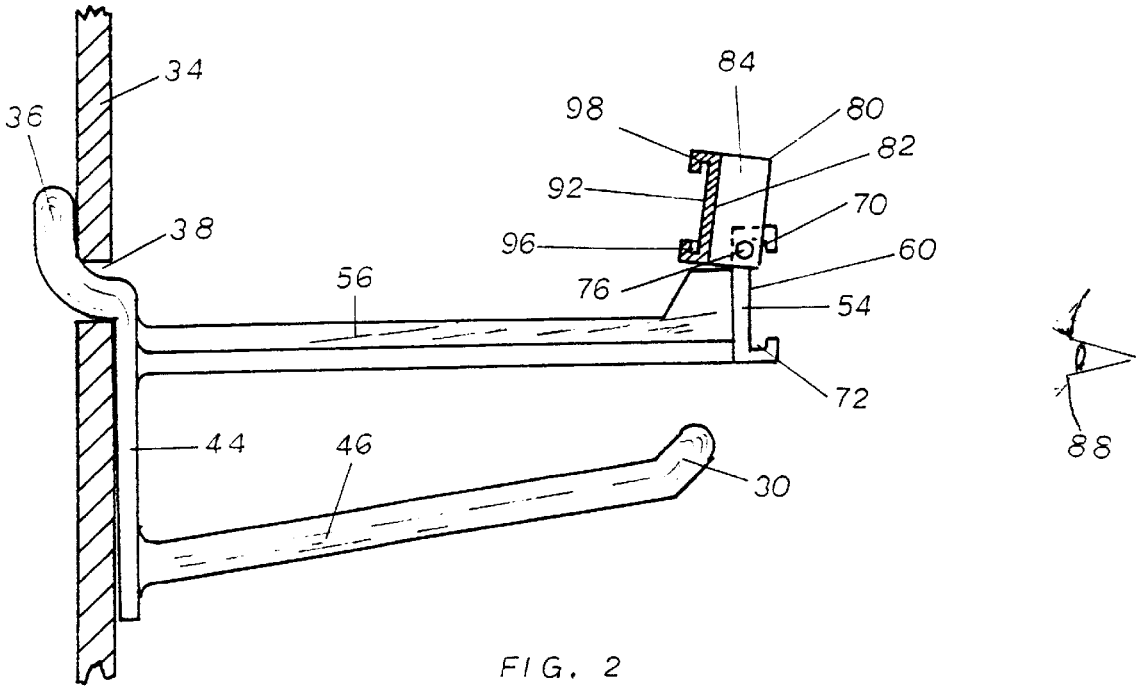
FIG. 2 is a left side view of the system of FIG. 1, with a rotatable panel of the system. The panel is shown in cross section along lines 2—2 of FIG. 9.

In FIGS. 1 and 2, panel 80 side 82 is rotated away from front 60 of panel 54 so that side 82 of panel 80 and front 60 of display panel 54 are presented for viewing by an observer 88 in front of display hook system 30. As best seen in FIG. 2 rotation of panel 8) away from front 60 of panel 54 will be stopped with side 82 of panel 80 supported in the vertical with the edge 80' of panel 80 on the upper edge of upstanding leg 56". Side 82 provides information, for example, by means of a pressure sensitive label located over each rod 46 that indicates what product goes on the rod.

Figure 3:
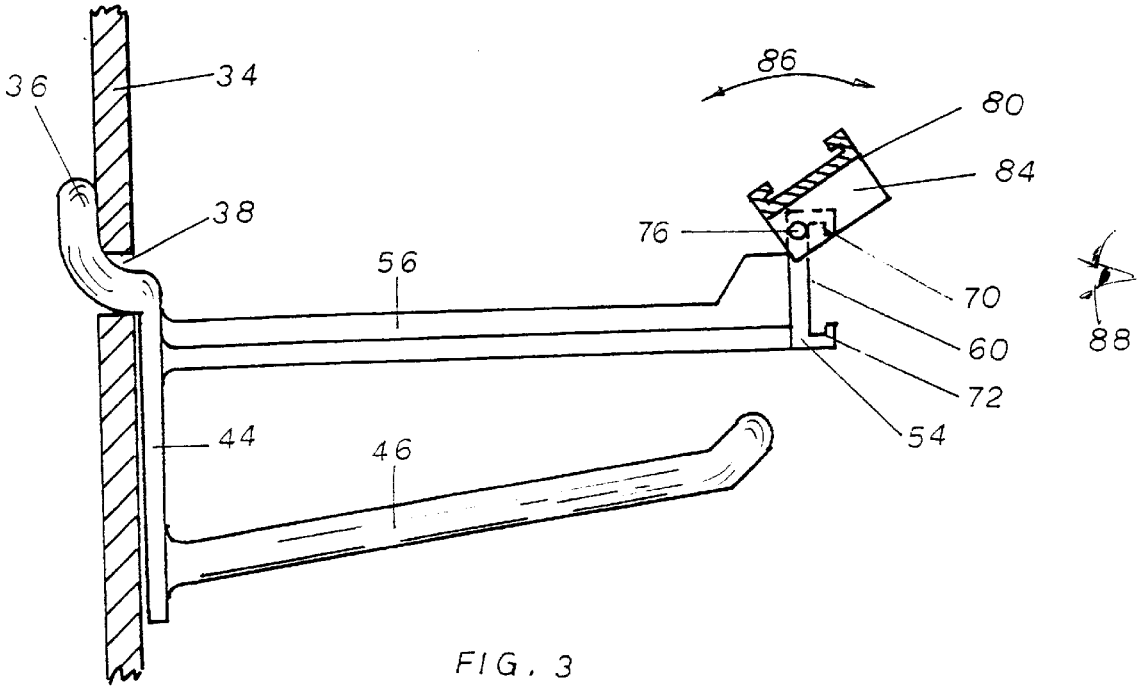
FIG. 3 is a left side view of the system of FIG. 1, with a rotatable panel of the system. The panel is shown in cross section along lines 2—2 of FIG. 9.

In FIG. 3, panel 80 is in rotation 86 on pivots 76 between the position shown in FIG. 2 and the position shown in FIG. 3. In FIG. 4, side 82 of panel 80 faces front 60 of display panel 54. In this position, side 92 of panel 80 is presented for viewing by the observer.

Side 92 of panel 80 has upper and lower slots 96 and 98 respectively which provide means for holding one or more information display cards for reading by eye or machine.

The display hook system is strong, provides a stable support for articles, and is inexpensive to make and to stock ready for use. The system is preferably assembled from only two unitary parts. Preferably every element in an embodiment of the invention which may include up to all of mounting finger 36, panel 44, hangar rod 46, arm 56, pivots 76, and panel 54 is an integral molding. That is, it is molded in a single piece. Preferably the molding is from HIPS, and may include reinforcement elements within the integral molding. Dual display panel 80 is also an integral molding providing a single piece. To assemble system 30, simply snap dual display panel 80 by bearing recesses 78 on pivot pins 76 of display panel 54.

Display hook system 30 may be made in any length 64 desired, and have as many article support hooks as desired. One or more mounting fingers 36 or other means to hook wall perforations may be used to provide adequate attachment to a perforated wall such as pegboard. In another embodiment of the invention, holes for screws through panel 44, or glue on the back of panel 44 may be used for attaching of the display hook system to a wall.

Figure 15:
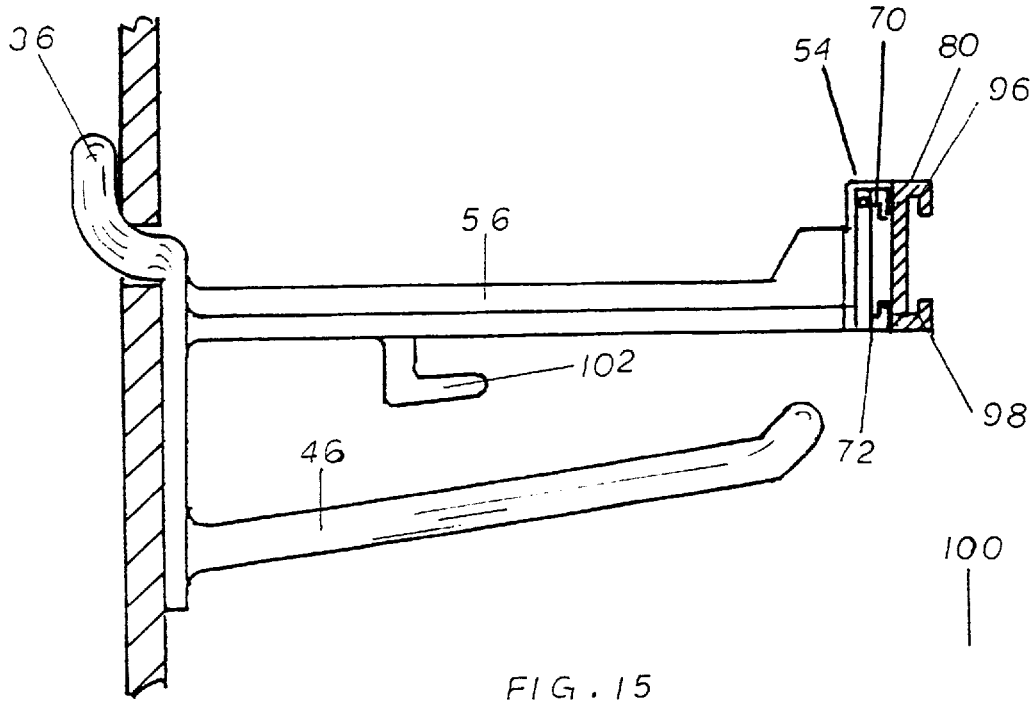
FIG. 15 is a left side view of another display hook system of the invention.

In display hook system 100 shown in FIG. 15, the article support means is mounted on panel 44 by attaching the article support means, for example hook 102, to arm 56.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A display hook system comprising:

a base, a first panel, a second panel, a panel support means and an article support means;

said base having a top, a bottom, a front, and a back;

said first panel having a top, a bottom, a front, and a back; said base lying in a first plane and including means for mounting said base on a display wall, said panel support means extending forwardly from said top and front of said base to said bottom and back of said first panel for rigidly supporting said first panel forwardly of said base in a second plane parallel to said first plane of said base, said article support means extending forwardly from said bottom and in front of said base and terminating in a free end spaced below said first panel sufficiently for supporting an article to be displayed;

said second panel having a top, a bottom, a first side, and a second side;

a pivotal mounting means situated between said top of said first panel and said top of said second Panel for mounting said second panel on said first panel; and said second panel being pivotally movable about said pivotal mounting means to and from a first position in which said second panel lies within a third plane parallel to said first and second planes of said base and said first panel with said first side of said second panel in juxtaposition with and facing the front of said first panel and with said second side of said second panel facing forwardly for viewing by an observer and constituting means for displaying information at a second position with said second panel above said first panel, said top of said second panel and said top of said first panel being in vertical adjacency, with said first side of said second panel and said front of said first panel facing forwardly and constituting means for displaying information regarding an article to displayed on said article display means for viewing by an observer.

2. The system of claim 1, wherein:

said base, said panel support means, said first panel, and said article support means comprise an integral molding.

3. The system of claim 2, wherein:

said means for mounting said base on a display wall extends from said back of said base and comprises means for hooking a display wall perforation.

4. The system of claim 2, wherein:

said article support means comprises at least one rod extending in a plane substantially normal to the plane of said base.

5. The system of claim 4 wherein said article support means comprises an upwardly angled free end.

6. The system of claim 1 wherein said panel support means extends in a plane normal to the first plane of said base and includes a raised portion adjacent said bottom and back of said first panel, said raised portion constituting means for stopping pivotal movement of said second panel past said second position.

* * * * *